US005157950A

United States Patent [19]

Demarest, Jr.

[11] Patent Number: 5,157,950

[45] Date of Patent: Oct. 27, 1992

[54] WINDOW LOCK

[76] Inventor: Russell G. Demarest, Jr., 60 Forest Rd., Glen Rock, N.J. 07452

[21] Appl. No.: 756,969

[22] Filed: Sep. 9, 1991

[51] Int. Cl.[5] ..... E05B 65/08; E05C 5/00

[52] U.S. Cl. ..... 70/90; 70/125; 70/330; 70/332; 70/446; 292/67

[58] Field of Search ..... 70/89, 90, 125, 128, 70/330-332, 432, 446; 292/57, 63, 67, DIG. 20, DIG. 33, DIG. 46, DIG. 47

[56] References Cited

U.S. PATENT DOCUMENTS

| | | | |
|---|---|---|---|
| 229,894 | 7/1880 | Kolb et al. | 292/DIG. 20 X |
| 480,343 | 8/1892 | Rabbeth | 292/DIG. 20 X |
| 523,090 | 7/1894 | Voll | 292/63 |
| 1,097,379 | 5/1914 | Tresselt | 70/90 |
| 3,277,677 | 10/1966 | Hurvitz | 70/90 |

FOREIGN PATENT DOCUMENTS

| | | | |
|---|---|---|---|
| 871 | of 1861 | United Kingdom | 292/DIG. 20 |
| 4288 | of 1886 | United Kingdom | 292/67 |
| 6825 | of 1895 | United Kingdom | 292/67 |

*Primary Examiner*—Lloyd A. Gall
*Attorney, Agent, or Firm*—Samuelson & Jacob

[57] ABSTRACT

A window lock for securing a first window member against unauthorized movement relative to a second window member, the window lock including a bolt mounted for sliding movement in a drum journaled for rotation on a hub throughout an arc of rotation, the hub being affixed to the first window member and the bolt carrying a key and a latch engaged with a cavity in a housing affixed to the second window member throughout the arc of rotation of the drum when the bolt is advanced, the hub having a recess oriented for receiving the key of the bolt only when the bolt is located at a predetermined angular position within the arc of rotation where the key is registered with the recess to permit retraction of the bolt and corresponding retraction of the latch from the cavity, the orientation of the recess being masked from unauthorized view such that visual verification of the predetermined angular position of the bolt is restricted to an authorized operator.

15 Claims, 5 Drawing Sheets

WINDOW LOCK

The present invention relates generally to locks and pertains, more specifically, to window locks used to deter unauthorized entry through a window, and especially a window in a residence or in a small business or commercial building.

Window locks have been constructed in a very wide variety of configurations in attempts to provide a lock which is at once secure against unauthorized opening and entry, yet is simple enough in operation to facilitate the authorized opening of a window. Various approaches in both keyed and keyless locks have provided many advantages, but suffer from some disadvantages. For example, keyed locks, while quite secure against unauthorized entry, require that a key be available and ready whenever an authorized opening is desired. The requirement for a key often slows the opening process and can constitute a hazard in an emergent situation, such as during escape from a fire, especially if the necessary key is lost or mislaid. Combination locks avoid the necessity for a key, but require time-consuming manipulations. Moreover, in an emergency, a mental lapse could result in a disastrous delay in opening the lock.

The present invention provides an exceptionally high degree of protection against unauthorized opening of a window, without the necessity for a key or for the memorization of a combination for authorized opening, and enables such authorized opening to be accomplished quickly with ease. As such, the present invention attains several objects and advantages, some of which may be summarized as follows: Provides a high degree of protection against unauthorized opening of a window, while enabling increased ease in accomplishing authorized opening of the window; deters breaking and entering through a window while enabling rapid opening of the window from the inside of the window, without the necessity for a key or a memorized combination; increases the ease with which a locked window can be unlocked without the need for excessive and time-consuming manipulations or routines for releasing the lock; requires no special installation tools, skills or preparation for accomplishing installation in any one of a large variety of windows currently in use; is made up of a minimal number of component parts of simple configuration for economy of manufacture and low purchase price; eliminates the necessity for the use of complex electronic or electromagnetic alarm systems and the attendant problems of potential periodic false alarms associated with such systems; provides a rugged construction which enables exemplary performance over a long service life; is capable of economical manufacture in large numbers of uniform high quality.

The above objects and advantages, as well as further objects and advantages, are attained by the present invention which may be described briefly as a window lock for use in connection with a window having a first window member and a second window member to secure the first window member against unauthorized movement in a direction relative to the second window member, the window lock comprising: a hub having an outer periphery and a recess in the hub, the recess including an opening at the outer periphery of the hub and extending in a direction inwardly from the opening, the hub including mounting means for mounting the hub on the first window member with the opening of the recess confronting the second window member; a drum juxtaposed with the hub and mounted for rotation relative to the hub throughout at least an arc of rotation about an axis aligned generally with the direction of relative movement of the first and second window members; a bolt mounted for rotation with the drum and for sliding movement relative to the drum in directions transverse to the axis of rotation of the drum, the bolt including a latch extending outwardly for swinging through a sector as the drum is rotated through said arc of rotation, and a key for movement between an extended position and a retracted position in response to movement of the bolt between corresponding extended and retracted positions; and a housing including a cavity and mounting means for mounting the housing on the second window member with the cavity confronting the latch of the bolt and in such close proximity with the bolt as to receive the latch within the cavity when the bolt is in the extended position, the cavity extending laterally to accommodate the swinging movement of the latch, when the bolt is in the extended position and the latch is received within the cavity, while essentially precluding movement of the latch in directions aligned generally parallel with the direction of relative movement of the first and second window members; the orientation of the recess and the orientation of the key being such that upon rotation of the drum relative to the hub, the key is registered with the recess only at a predetermined angular position of the drum within the arc of rotation of the drum, whereby the key maintains the bolt in the extended position, with the latch extending into the cavity of the housing, throughout all angular positions of the drum other than the predetermined angular position, and is selectively movable into the recess only at the predetermined angular position of the drum to enable selected retraction of the latch from the cavity for authorized relative movement of the first and second window members.

The invention will be understood more fully, while still further objects and advantages will become apparent, in the following detailed description of preferred embodiments of the invention illustrated in the accompanying drawing, in which:

FIG. 1 an exploded perspective view of a window lock constructed in accordance with the present invention;

Figure 1:
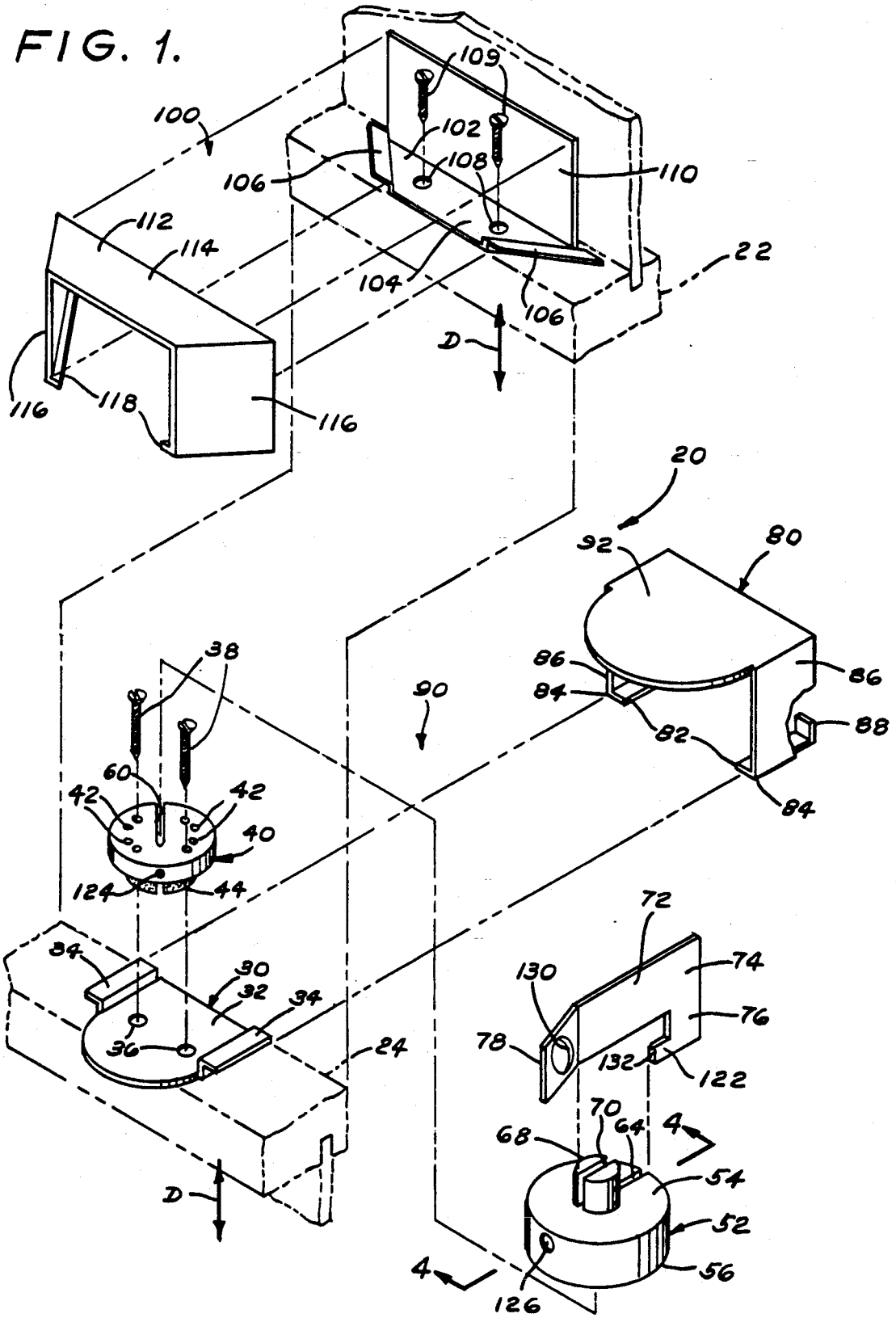
Figure 2:
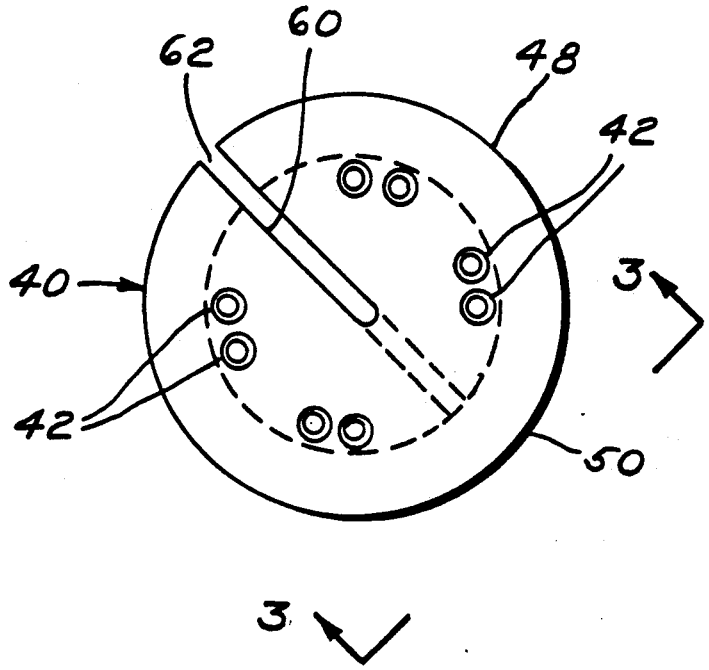
FIG. 2 is a top plan view of a component part of the window lock.
Figure 3:
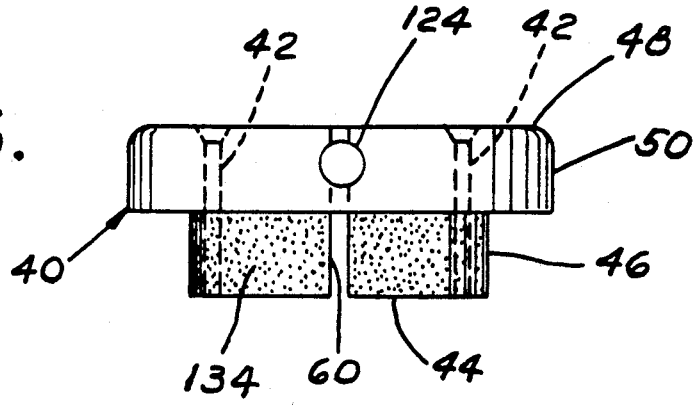
FIG. 3 is a front elevational view of the component part of FIG. 2, as viewed from line 3—3 of FIG. 2.
Figure 4:
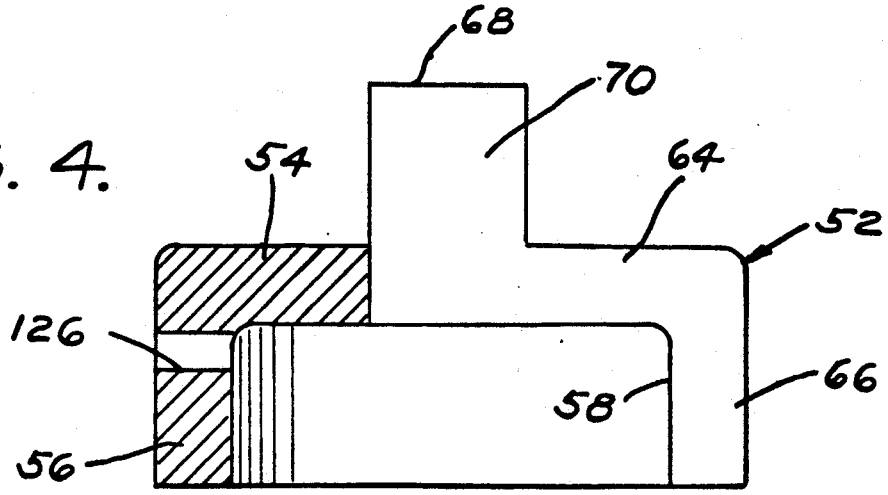
FIG. 4 is an enlarged cross-sectional view of another component part, taken along line 4—4 of FIG. 1.

Referring now to the drawing, and especially to FIGS. 1 through 4 thereof, a window lock constructed in accordance with the invention is illustrated generally at 20 and is to be installed on a double-hung window having a first window member shown in the form of an upper sash, a portion of which is illustrated in phantom at 22, and a second window member shown in the form of a lower sash, a portion of which is illustrated in phantom at 24. The upper sash 22 and the lower sash 24 are juxtaposed with one another when the window is closed (see FIG. 5) in a conventional manner well-known in the art of windows, and move relative to one another in directions depicted at D for accomplishing opening and closing. In order to preclude unauthorized opening of the window, the upper and lower sashes 22 and 24 are to be locked together, when closed, utilizing window lock 20.

Window lock 20 includes a lower base plate 30 having a basal web 32 and a pair of laterally opposed tracks 34 formed unitary with the basal web 32 and extending longitudinally along the base plate 30. A pair of apertures 36 receive fasteners in the form of screws 38 which pass through the apertures 36 to be anchored in the lower sash 24. A hub 40 includes a plurality of pairs of diametrically opposed mounting holes 42 located along a circle having a diameter matching the spacing between apertures 36 so that the screws 38 are passed through one pair of holes 42 to affix both the hub 40 and the base plate 30 to the lower sash 24, thereby serving as mounting means for mounting the hub 40 on the lower sash 24. Hub 40 has a neck 44 with a cylindrical surface 46 extending upwardly from the basal web 32 and a flange 48 extending radially outwardly beyond the cylindrical surface 46 to a cylindrical bearing surface 50 along the outer perimeter of the flange 48.

A drum 52 is placed over the hub 40 and is mounted for rotation on the hub 40 about an axis A, which axis is aligned generally parallel to the directions D when the hub 40 is affixed to the lower sash 24, as shown. Drum 52 includes an uppermost top wall 54 and a depending cylindrical wall in the form of a skirt 56 which depends downwardly from the top wall 54 and includes an inner cylindrical bearing surface 58 which is journaled on the bearing surface 50 of the hub 40 to facilitate rotation of the drum 52 on the hub 40. Hub 40 has a recess in the form of a slot 60 extending radially inwardly from an opening 62 of the slot 60 at the outer perimeter of the flange 48 toward the center of the hub 40. Likewise, drum 52 has a slot 64 extending axially through the top wall 54 in a radial direction from an opening 66 at the skirt 56 toward the center of the drum 52. A post 68 is integral with the drum 52 and projects axially upwardly from the top wall 54, and a portion 70 of the slot 64 passes through the post 68. A bolt 72 is mounted for rotation with the drum 52 by being placed within the slot 64, and especially within the portion 70 of the slot 64. Bolt 72 is slidable within the slot 64 in directions extending along the length of the bolt 72, transverse to the axis A of rotation of the drum 52. Bolt 72 includes a latch 74, a key 76, and an operating finger grip 78.

Figure 5:
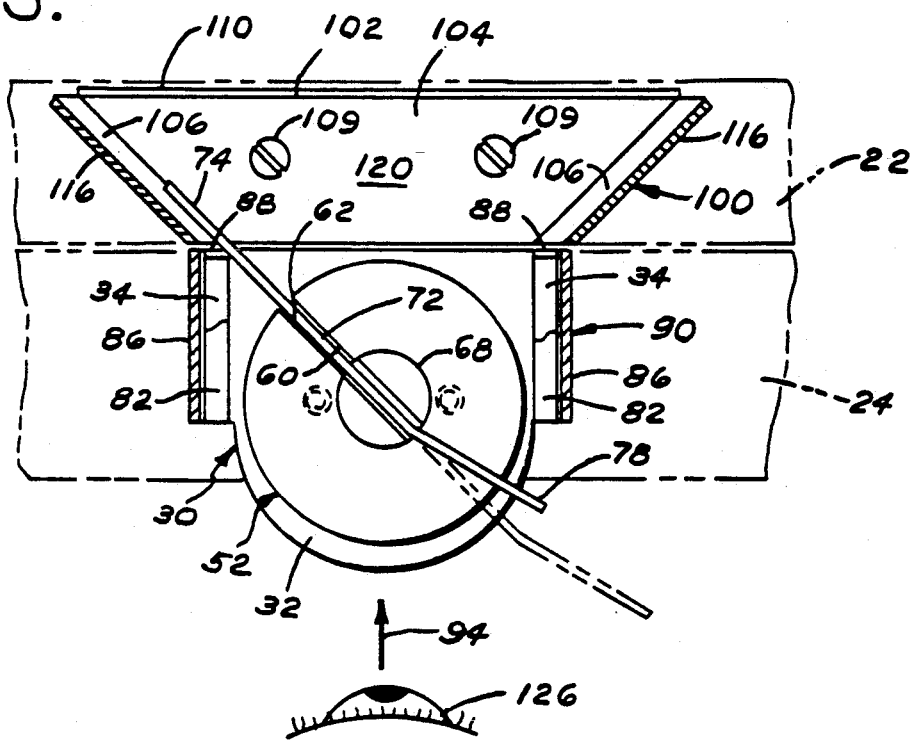
FIG. 5 is a top plan view of the window lock, with portions cut away to reveal internal component parts.
Figure 6:
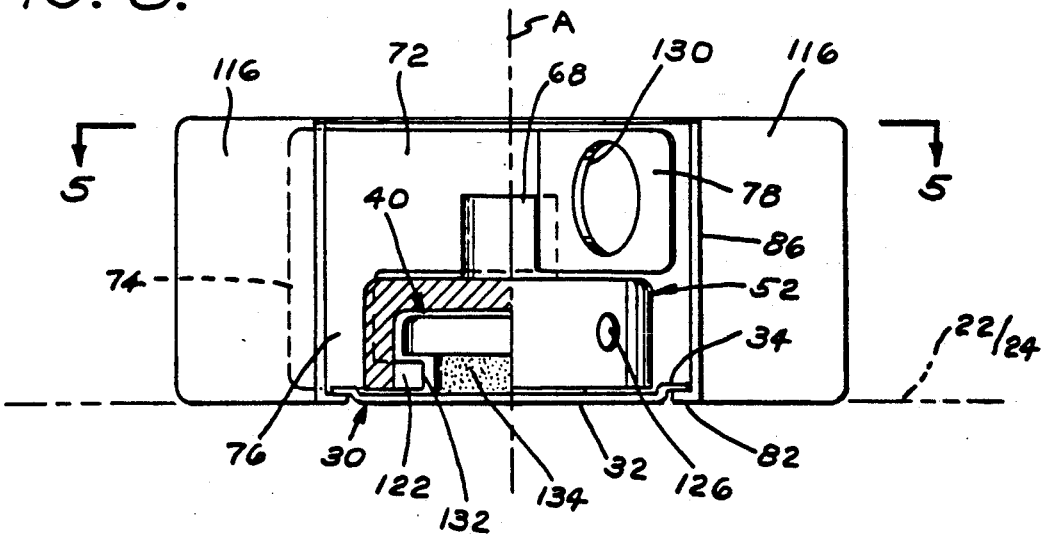
FIG. 6 is a front elevational view of the window lock, with portions cut away to reveal internal component parts.

Turning now to FIGS. 5 and 6, as well as to FIGS. 1 through 4, upon affixation of the base plate 30 and the hub 40 to the lower sash 24, by means of the screws 38, placement of the drum 52 over the hub 40, and insertion of the bolt 72 into the slot 64, a lower housing member 80 is assembled with the base plate 30 by sliding rails 82, located at the lowermost edges 84 of the side walls 86 of the lower housing member 80, into the tracks 34 of the base plate 30 until stops 88 at the rear ends of rails 82 abut the rear ends of the tracks 34 to complete a lower housing 90. A top wall 92 of the lower housing member 80 then overlies the assembled hub 40, drum 52 and bolt 72 to enclose the assembly within lower housing 90 in such a way that all of the component parts within the lower housing 90 remain assembled. In addition, the enclosure provided by lower housing 90 masks the assembled components from view in all directions except essentially directly from the front of the assembly, as depicted at 94 in FIG. 5.

An upper housing 100 includes an upper base plate 102 having a basal web 104 and a pair of laterally opposed tracks 106 formed unitary with the basal web 104 and extending along the base plate 102 at an acute angle to one another. A pair of apertures 108 receive fasteners in the form of screws 109 which pass through the apertures 108 to be anchored in the upper sash 22. A rear wall 110 is unitary with the base plate 102 along the rear edge of the basal web 104 and extends upwardly essentially normal to the basal web 104. An upper housing member 112 includes a top wall 114 and depending side walls 116 unitary with the top wall 114 and extending at an acute angle to one another along opposite side edges of the top wall 114. A pair of opposed side rails 118 extend along the lowermost edges of the side walls 116 and are secured beneath corresponding tracks 106 to complete the upper housing 100 and establish a cavity 120 within the upper housing 100.

The lower and upper housings 90 and 100 are assembled and installed, as described above, while the window is open. Upon closing the window, the upper and lower sashes 22 and 24 are juxtaposed, as illustrated in FIGS. 5 and 6, bringing the lower and upper housings 90 and 100 into such juxtaposition that disassembly of the lower and upper housings 90 and 100 is precluded by virtue of the arrangement of the interengaged corresponding tracks 34, 106 and rails 82, 118, and stops 88. At the same time, the opening 62 of the slot 60 in the hub 40 confronts the upper sash 22 and with the latch 74 of the bolt 72 confronts the cavity 120 of the upper housing 100. In order to lock the window, that is, in order to preclude relative movement between the upper and lower sashes 22 and 24 when the sashes 22 and 24 are so juxtaposed, latch 74 is advanced into cavity 120 by grasping the finger grip 78 of bolt 72 and advancing the bolt 72 in the direction from the lower sash 24 toward the upper sash 22 until the latch 74 enters the cavity 120, as shown in full lines in FIGS. 5 and 6. The bolt 72 then is rotated, with the drum 52, about axis A to any angular position within an arc of rotation within the sector delineated by the angled side walls 116 of the upper housing member 112, thereby swinging the latch 74, and the key 76, within that sector. The latch 74, being thus captured within the cavity 120 of the upper housing 100, secures the sashes 22 and 24 against relative movement. The bolt 72 is held in stable captivity by the top wall 92 of the lower housing member 80 and by virtue of the placement of a projecting portion 122 of the key 76 beneath the flange 48 of the hub 40, as well as the location of the bolt 72 in the portion 70 of slot 60. Thus, regardless of the angular position of the bolt 72 within the arc of rotation of the bolt 72, the advanced extended position of the bolt 72 and the latch 74 will maintain the window locked.

In order to unlock the window, for relative movement between the upper and lower sashes 22 and 24, the bolt 72 must be retracted to retract the latch 74 from the cavity 120 in the upper housing 100. Such retraction of the bolt 72 is accomplished by rotating the drum 52 relative to the hub 40 so as to bring the key 76 of the bolt 72 into registration with the slot 60 in the hub 40 and then retracting the bolt 72, the retraction being enabled by movement of the key 76 into the slot 60. In all other angular positions of the bolt 72, attempts at retracting the bolt 72 will bring the key 76 into engagement with the hub 40 and retraction of the bolt 72 will be precluded. It is only at the predetermined angular position of the drum 52, where the key 76 is registered with the slot 60, that the bolt 72 may be moved to the retracted position and the latch 74 may be retracted from the cavity 120 of the upper housing 100. In all other angular positions, the key 76 maintains the bolt 72 in the extended position with the latch 74 extending into the cavity 120.

The predetermined angular position of the drum 52 is reached quickly and with ease from inside the window. Thus, the position of the slot 60 in the hub 40 is denoted by a visible mark 124 placed on the outer periphery of the flange 48 of the hub 40. When an aperture 126 in the skirt 56 of the drum 52 is registered with the mark 124, as observed along 94 by an authorized operator 126 inside the window, the key 76 of the bolt 72 is registered with the slot 60 in the hub 40 and retraction of the bolt 72 is enabled. Such rotation of the drum 52 and retraction of the bolt 72 is facilitated by the angled finger grip 78 and an opening 130 in the finger grip 78. Because of the configuration and arrangement of the upper and lower housings 100 and 90, as well as the remaining components of the window lock 20, an unauthorized person outside the window cannot readily observe the restricted view visual indication means provided by the mark 124 and the aperture 126, and the ability of such an unauthorized opening of the window lock 20 is so impaired as to discourage breaking and entering through the window. This is especially true in connection with small-paned windows, where breaking and entering usually is accomplished merely by breaking and entering through a small pane adjacent the window lock. Attempts at opening the window lock 20 by urging the key 76 toward the retracted position while at the same time attempting rotation of the drum 52 to seek registration of the key 76 with the slot 60 will bring the edge 132 of projecting portion 122 of the key 76 into contact with the cylindrical surface 46 of the neck 44 of the hub 40. The cylindrical surface 46 is provided with a roughened surface, as depicted at 134, so that upon contact of the edge 132 of key 76 with the cylindrical surface 46 the roughened surface 134 impedes rotation of the drum 52 and subverts the attempt at quick location of the predetermined angular position of the drum 52 wherein the key is registered with the slot 60.

The predetermined angular position of the drum 52 within the arc of rotation of the drum 52 on the hub 40 may be selected from several alternatives presented upon installation of the window lock 20. The selection is made by choosing which one of the plurality of diametrically opposed pairs of holes 42 in the hub 40 is selected for the reception of the screws 38. Thus, the orientation of the slot 60 in the hub 40, relative to the lower sash 24 and the base plate 30, is determined by which pair of holes 42 is selected for alignment with the apertures 36 in the basal web 32 and the selection is made readily upon installation. The installation is accomplished with ease, requiring no special tools or skills.

Referring now to FIGS. 7 through 11, another embodiment of the invention is illustrated in the form of window lock 200 which is constructed for use in connection with a casement window wherein the window sashes 202 and 204 move relative to one another, along directions depicted at DD, in a swinging motion rather than sliding relative to one another, as in a double-hung window. As in the earlier-described embodiment, window lock 200 includes two housings, and the housings are located side-by-side. Thus, a first housing 210 is affixed to sash 202 by means of screws 212 passing through a base plate 214 having tracks 216 for receiving complementary rails 218 at the corresponding edges of the walls 220 of a housing member 222 to secure the housing member 222 to the base plate 214. The walls 220 are angled to establish a cavity 224 within the housing 210 which follows a sector-like configuration. The cavity 224 is closed at the far end by a wall 226 unitary with the base plate 214 to preclude entry into the cavity 224 from the far end, and removal of the housing member 222 from the base plate 214, while the window is closed, is precluded by the angled arrangement of the tracks 216 and rails 218.

A second housing 230 is affixed to the other sash 204 by means of screws 232 passing through apertures 233 in a base plate 234 having tracks 236 extending along opposite edges of the base plate 234 and engaged by complementary rails 238 extending along corresponding opposite edges of opposite walls 240 of a housing member 242. The opposite walls 240 are angled so that once the housing member 242 is in place on the base plate 234 removal of the housing member 242 from the base plate 234 is precluded while the window is closed.

Subsequent to affixing the base plate 234 to the sash 204, and prior to assembling the housing member 242 with the base plate 234, a hub 250 is placed on the base plate 234 by inserting a pair of diametrically opposite mounting projections 252, which are integral with and which depend from the bottom of the hub 250, into one selected pair of a plurality of complementary diametrically opposite mounting holes 254 in the base plate 234. The selected pair of holes 254 determines the orientation of a slot 260 in the hub 250 relative to the base plate 234 and, as in the earlier-described embodiment, the installer is free to select any desired orientation within the range provided by the plurality of pairs of holes 254. A visible marking 262 is located on the upper surface 264 of the hub 250 for indicating the selected orientation, in a manner similar to that described above. The hub 250 includes a flange 265 with a bearing surface 266 and a recessed roughened surface 268.

A drum 270 is placed over the hub 250 and is journaled for rotation relative to the hub 250 about an axis AA, by virtue of the engagement of internal cylindrical surface 272 of cylindrical wall 273 of the drum 270 with the bearing surface 266 of the hub 250, axis AA being essentially in alignment with the direction of movement indicated at DD. A transverse slot 274 in the drum 270 includes a slot portion 276 extending through a post 278 projecting from the drum 270 and a bolt 280 is received within the slot 274, and especially within the slot portion 276, for sliding movement relative to the drum 270. Once the bolt 280 is in place, the housing member 242 is secured to the base plate 234 to capture the assembled hub 250, drum 270 and bolt 280 within the housing 230. The bolt 280 includes a latch 282, a key 284 and an operating finger grip 286 having finger grip indentations 288.

Figure 7:
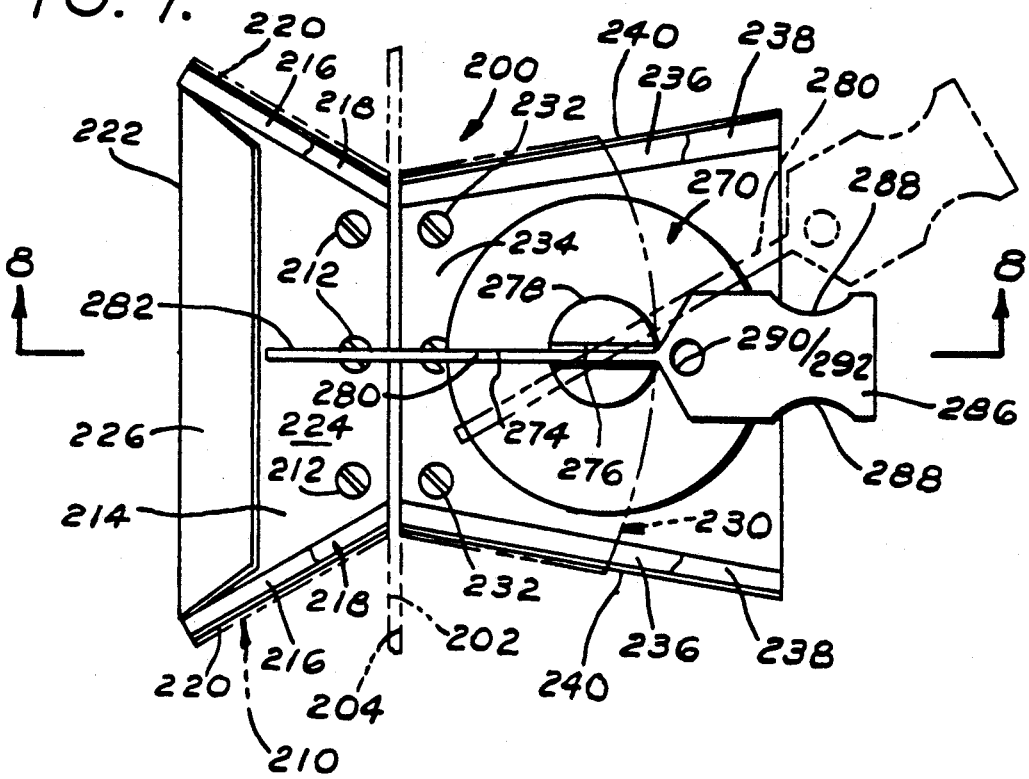
FIG. 7 is a front elevational view of another window lock constructed in accordance with the present invention.
Figure 8:
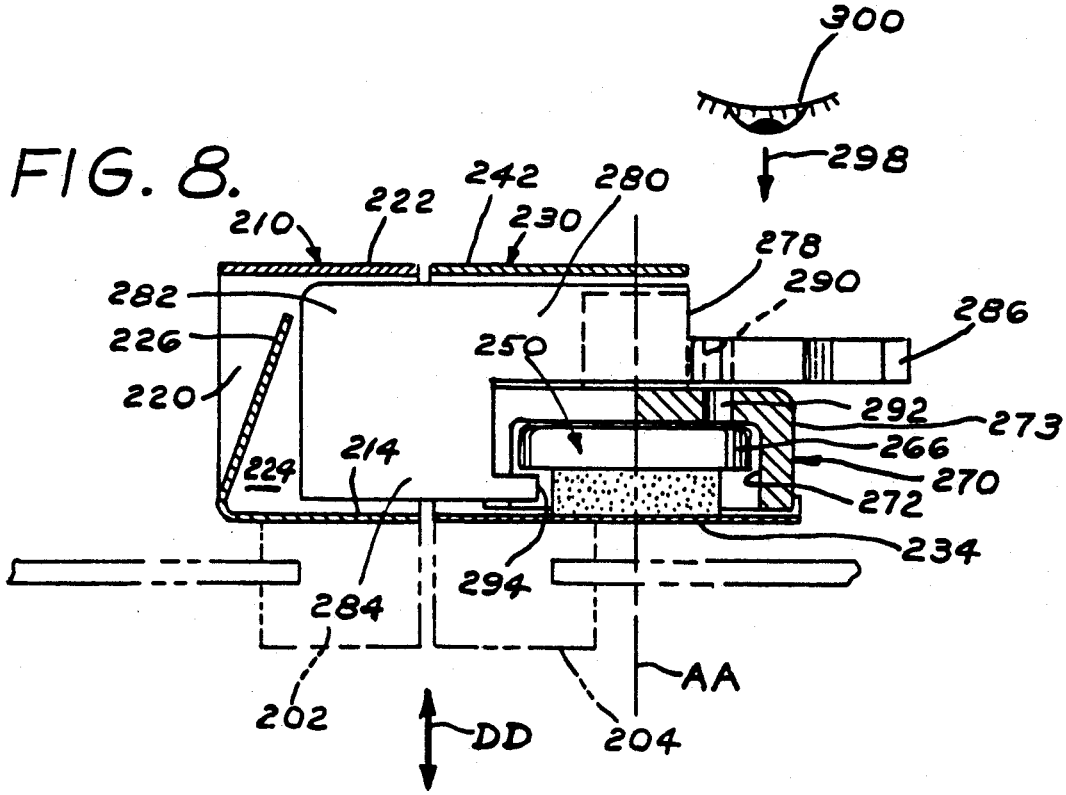
FIG. 8 is a cross-sectional view taken along line 8—8 of FIG. 7.
Figure 9:
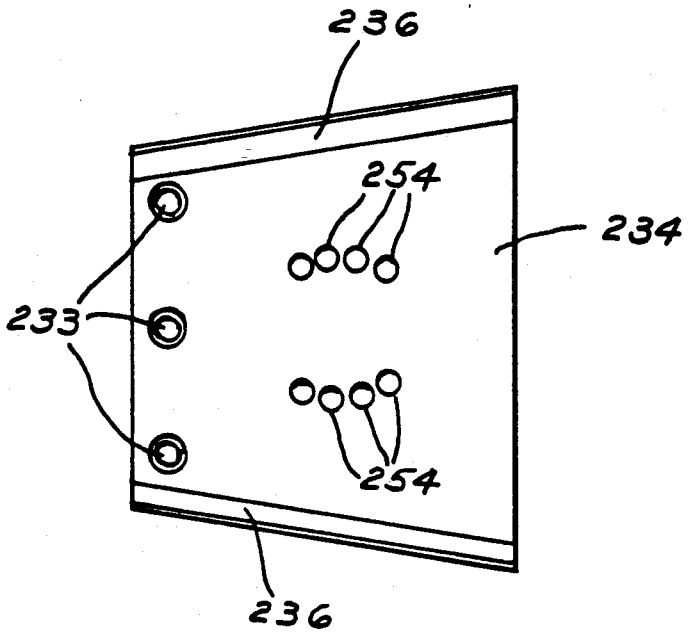
FIG. 9 is a top plan view of a component part of the window lock of FIG. 7.
Figure 10:
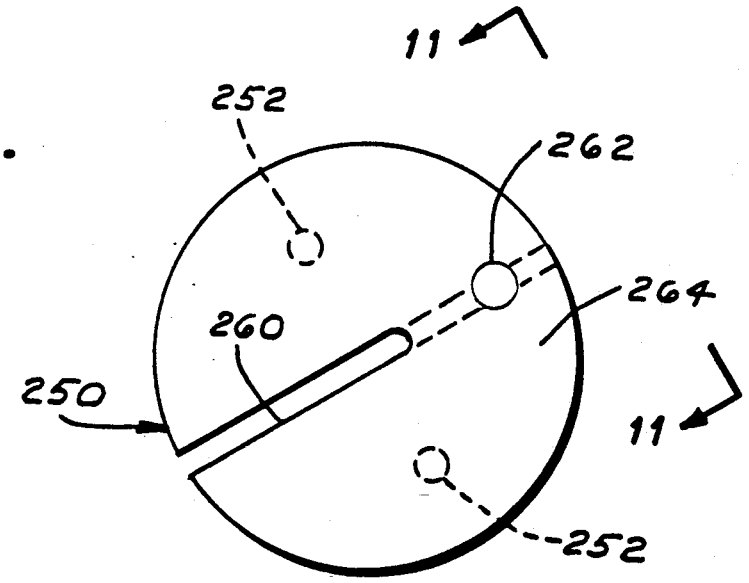
FIG. 10 is a top plan view, slightly enlarged, of another component part of the window lock.
Figure 11:
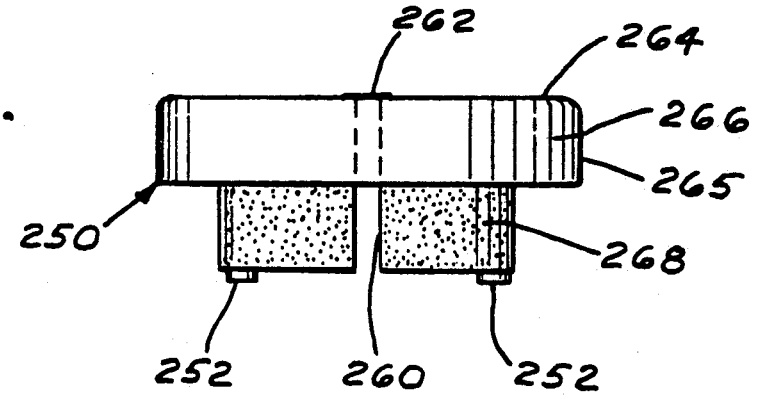
FIG. 11 a front elevational view of the component part of FIG. 10, as viewed from line 11—11 of FIG. 10.

When the window is closed, as depicted in FIGS. 7 and 8, the bolt 280 and the latch 282 confront the cavity 224 of the housing 210. The bolt 280 then is moved to an extended position, as shown in full lines, and the latch 282 extends into the cavity 224 of the housing 210 to lock the sashes 202 and 204 against movement relative to one another. In the extended position of the bolt 280, the drum 270 is free to rotate throughout the arc of rotation delineated by the angled walls 220 of the housing 210 and the window lock 200 remains locked. In order to unlock the window lock 200 and enable opening of the window, the drum 270 is rotated to the predetermined angular position where the key 284 is registered with the slot 260 in the hub 250 so that the bolt 280 may be moved to the retracted position illustrated in phantom in FIG. 7, thereby retracting the key 284 and withdrawing the key 284 from the cavity 224 to free the sashes 202 and 204 for movement relative to one another. The predetermined angular position of the drum 270 is indicated visually by viewing the mark 262 through apertures 290 and 292 in the finger grip 286 and in the drum 270, respectively, which apertures 290 and 292 are registered with the mark 262 when the drum 270 is in the predetermined angular position. Such visual verification of the predetermined angular position is restricted to viewing from inside the window, as indicated at 298, by an authorized operator 300. As before, rotation of the drum 270 with the key 284 urged against the hub 250 at all other angular positions is impeded by the engagement of the edge 294 of the key 284 with the roughened surface 268 on the hub 250.

It will be seen that the window lock of the present invention attains all of the objects and advantages summarized above; namely: Provides a high degree of protection against unauthorized opening of a window, while enabling increased ease in accomplishing authorized opening of the window; deters breaking and entering through a window while enabling rapid opening of the window from the inside of the window, without the necessity for a key or a memorized combination; increases the ease with which a locked window can be unlocked without the need for excessive and time-consuming manipulations or routines for releasing the lock; requires no special installation tools, skills or preparation for accomplishing installation in any one of a large variety of windows currently in use; is made up of a minimal number of component parts of simple configuration for economy of manufacture and low purchase price; eliminates the necessity for the use of complex electronic or electromagnetic alarm systems and the attendant problems of potential periodic false alarms associated with such systems; provides a rugged construction which enables exemplary performance over a long service life; is capable of economical manufacture in large numbers of uniform high quality.

It is to be understood that the above detailed description of preferred embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. A window lock for use in connection with a window having a first window member and a second window member to secure the first window member against unauthorized movement in a direction relative to the second window member, the window lock comprising:

a hub having an outer periphery and a recess in the hub, the recess including an opening at the outer periphery of the hub and extending in a direction inwardly from the opening, the hub including mounting means for mounting the hub on the first window member with the opening of the recess confronting the second window member;

a drum juxtaposed with the hub and mounted for rotation relative to the hub throughout at least an arc of rotation about an axis aligned generally with the direction of relative movement of the first and second window members;

a bolt mounted for rotation with the drum and for sliding movement relative to the drum in directions transverse to the axis of rotation of the drum, the bolt including a latch extending outwardly for swinging through a sector as the drum is rotated through said arc of rotation, and a key for movement between an extended position and a retracted position in response to movement of the bolt between corresponding extended and retracted positions and a housing including a cavity and mounting means for mounting the housing on the second window member with the cavity confronting the latch of the bolt and in such close proximity with the bolt as to receive the latch within the cavity when the bolt is in the extended position, the cavity extending laterally to accommodate the swinging movement of the latch, when the bolt is in the extended position and the latch is received within the cavity, while essentially precluding movement of the latch in directions aligned generally parallel with the direction of relative movement of the first and second window members;

the orientation of the recess and the orientation of the key being such that upon rotation of the drum relative to the hub, the key is registered with the recess only at a predetermined angular position of the drum within the arc of rotation of the drum, whereby the key maintains the bolt in the extended position, with the latch extending into the cavity of the housing, throughout all angular positions of the drum other than the predetermined angular position, and is selectively movable into the recess only at the predetermined angular position of the drum to enable selected retraction of the latch from the cavity for authorized relative movement of the first and second window members.

2. The invention of claim 1 wherein the drum includes a drum portion so located with respect to the hub as to mask the recess from view, and the window lock includes indicator means having a restricted-view visual indicator for indicating the predetermined angular position of the drum relative to the hub.

3. The invention of claim 2 wherein the drum overlies the hub, and the drum portion includes a drum wall overlying the hub, the drum wall having a slot aligned with the key for enabling retraction of the key into the recess when the key is registered with the recess.

4. The invention of claim 3 wherein the restricted-view visual indicator includes an aperture in the drum wall and a visible indicator mark on the hub visible through the aperture when the drum is in the predetermined angular position where the key is registered with the recess.

5. The invention of claim 1 wherein the hub and the key include impedance means for impeding rotation of the drum relative to the hub upon engagement of the key with the hub in angular positions of the drum throughout the arc of rotation of the drum, other than the predetermined angular position.

6. The invention of claim 5 wherein the impedance means includes a roughened surface on the hub confronting the key in angular positions of the drum throughout the arc of rotation of the drum, other than the predetermined angular position.

7. The invention of claim 1 wherein the mounting means for mounting the hub on the first window member includes selective means for selecting the orientation of the recess relative to the first window member so as to select the predetermined angular position of the drum relative to the first window member.

8. The invention of claim 7 wherein the selective means includes a plurality of mounting holes for securing the hub relative to the first window member, the mounting holes being so arranged as to enable mounting of the hub in any selected one of a plurality of mounting positions, each mounting position corresponding to a different orientation of the recess relative to the first window member.

9. The invention of claim 1 wherein:

the recess comprises a first slot extending radially from the opening inwardly into the hub;

the drum has an outer periphery and includes a second slot having an opening at the outer periphery of the drum and extending radially inwardly;

the bolt is mounted for sliding movement within the second slot; and the drum is journaled for rotation on the hub for selective registration of the second slot with the first slot to register the key with the recess.

10. The invention of claim 9 wherein:

the hub includes a cylindrical surface and a flange extending radially outwardly beyond the cylindrical surface, the flange having an outer perimeter; and the key includes a radial portion confronting the cylindrical surface and extending radially inwardly beyond the outer perimeter of the flange.

11. The invention of claim 10 including impedance means for impeding rotation of the drum relative to the hub upon engagement of the key with the hub in angular positions of the drum throughout the arc of rotation of the drum, other than the predetermined angular position, the impedance means including a roughened surface on the hub confronting the radial portion of the key in angular positions of the drum throughout the arc of rotation of the drum, other than the predetermined angular position.

12. The invention of claim 10 wherein the drum includes a drum wall overlying the hub so as to mask the first slot from view, and the window lock includes indicator means having an aperture in the drum wall and a visible indicator mark on the hub visible through the aperture when the drum is in the predetermined angular position where the key is registered with the first slot.

13. The invention of claim 10 wherein the mounting means for mounting the hub on the first window member includes selective means for selecting the orientation of the first slot relative to the first window member so as to select the predetermined angular position of the drum relative to the first window member.

14. The invention of claim 13 wherein the selective means includes a plurality of mounting holes for securing the hub relative to the first window member, the mounting holes being so arranged as to enable mounting of the hub in any selected one of a plurality of mounting positions, each mounting position corresponding to a different orientation of the recess relative to the first window member.

15. The invention of claim 14 wherein the mounting holes are located in the hub.

* * * * *